US008847869B2

(12) United States Patent
Hou et al.

(10) Patent No.: US 8,847,869 B2
(45) Date of Patent: Sep. 30, 2014

(54) LIQUID CRYSTAL DISPLAY DEVICE AND METHOD FOR DRIVING THE SAME

(75) Inventors: Chun-cheng Hou, Pingzhen (TW); Yi-chiang Lai, Dayuan Township (TW); Min-wei Tsai, Zhongli (TW)

(73) Assignee: Chunghwa Picture Tubes, Ltd., Bade, Taoyuan County (TW)

( * ) Notice: Subject to any disclaimer, the term of this patent is extended or adjusted under 35 U.S.C. 154(b) by 940 days.

(21) Appl. No.: 12/982,865

(22) Filed: Dec. 30, 2010

(65) Prior Publication Data

US 2012/0098814 A1 Apr. 26, 2012

(30) Foreign Application Priority Data

Oct. 20, 2010 (TW) ..... 99135768 A

(51) Int. Cl.
*G09G 3/36* (2006.01)

(52) U.S. Cl.
CPC ..... *G09G 3/3677* (2013.01); *G09G 2310/0286* (2013.01); *G09G 2320/041* (2013.01)
USPC ..... 345/98; 345/99; 345/100

(58) Field of Classification Search
USPC ..... 345/98–100
See application file for complete search history.

(56) References Cited

U.S. PATENT DOCUMENTS

| | | | | |
|---|---|---|---|---|
| 4,952,032 | A * | 8/1990 | Inoue et al. | 345/101 |
| 2004/0174334 | A1 * | 9/2004 | Washio et al. | 345/102 |
| 2009/0102779 | A1 * | 4/2009 | Jo | 345/101 |
| 2009/0121998 | A1 * | 5/2009 | Ohkawa et al. | 345/100 |

FOREIGN PATENT DOCUMENTS

| | | | |
|---|---|---|---|
| CN | 101567172 | A | 10/2009 |
| CN | 101650924 | A | 2/2010 |
| CN | 101707054 | A | 5/2010 |
| JP | 2003-241722 | A | 8/2003 |
| TW | 512304 | | 12/2002 |
| TW | 567456 | | 12/2003 |
| TW | 200847094 | A | 12/2008 |

* cited by examiner

*Primary Examiner* — William Boddie
*Assistant Examiner* — Alecia D English
(74) *Attorney, Agent, or Firm* — Cheng-Ju Chiang

(57) ABSTRACT

A liquid crystal display device and a method for driving the same are disclosed. The liquid crystal display device includes a liquid crystal panel, a gate driver unit, a clock generator, and a temperature compensation unit. The liquid crystal panel includes a pixel array. The gate driver unit is utilized for generating a plurality of driving signals to drive the pixel unit. The clock generator is electrically coupled to the gate driver unit. The temperature compensation unit is electrically coupled to the gate driver unit and the clock generator. The temperature compensation unit is utilized for adjusting an output of the clock generator to compensate the driving signals of the gate driver unit according to a temperature variance.

7 Claims, 7 Drawing Sheets

LIQUID CRYSTAL DISPLAY DEVICE AND METHOD FOR DRIVING THE SAME

BACKGROUND OF THE INVENTION

1. Field of the Invention

The present invention generally relates to a display device and method for driving the same, and more particularly to a liquid crystal display device and a method for driving the same which are capable of solving a problem of a reduced turn-on current due to a reduced temperature.

2. Description of Prior Art

A liquid crystal display device comprises a plurality of gate lines, a plurality of source lines, and a plurality of pixels. The pixels are aligned as an array. Each one of the pixels is coupled to and controlled by one of the gate lines and one of the source lines for displaying images. Several additional gate driver integrated circuits (IC) provide required driving signals for the gate lines. A gate-in-panel (GIP) type of liquid crystal display (GIP LCD) device is developed recently. The additional gate driver integrated circuits are not used in the GIP LCD device. Driving circuits which are equivalent to the additional gate driver integrated circuits are manufactured on a liquid crystal panel of the GIP LCD device. Since the driving circuits being manufactured on the display panel are substituted for the gate driver integrated circuits, the cost of the gate driver integrated circuits can be reduced. In addition, the driving circuits can be manufactured in the processes of manufacturing the gate lines, the source lines, and the pixels without extra manufacturing processes.

Each of the driving circuits utilized in the GIP LCD device comprises a plurality of shift register units in series. Please refer to FIG. 1, which is a circuit diagram showing a shift register unit 540 and a clock generator 56 in the prior art. The shift register unit 540 comprises an SR flip-flop 5400, a pull-up thin film transistor (TFT) T3, and a pull-down thin film transistor T4. Please refer to FIG. 2, which illustrates a waveform of an output CLK from the clock generator 56. When the pull-up thin film transistor T3 is turned on, a gate line output $G_{NO}$ is the output CLK of the clock generator 56. The signal CLK is a pulse wave having a high level of a first voltage VGH and a low level of a second voltage VEEG. When the signal CLK from the clock generator 56 is at the first voltage VGH and an output from a Q terminal of the SR flip-flop 5400 is at a high level, the pull-up thin film transistor T3 is turned on and the pull-down thin film transistor T4 is turned off. When an output from a $\overline{Q}$ terminal of the SR flip-flop 5400 is at a high level, the pull-up thin film transistor T3 is turned off and the pull-down thin film transistor T4 is turned on. The gate line output $G_{NO}$ is at a third voltage VGL (not shown).

Please refer to FIG. 3, which illustrates curves indicating relationships between a turn-on current IDS v. a gate voltage VGS (I-V) of the pull-up thin film transistor T3 at different temperatures. As can be seen from FIG. 3, when the gate voltage of the pull-up thin film transistor T3 is fixed and the temperature is reduced, the turn-on current IDS of the pull-up thin film transistor T3 is reduced. The reduced turn-on current IDS will cause a turn-on delay of the gate line output $G_{NO}$ or an insufficient charging time of the pixels which are electrically coupled to the gate line output $G_{NO}$.

Therefore, there is a need for a solution to the above-mentioned problem of the reduced turn-on current IDS due to the reduced temperature.

SUMMARY OF THE INVENTION

An objective of the present invention is to provide a liquid crystal display device and a method for driving the same, which are capable of solving a problem of a reduced turn-on current due to a reduced temperature in a conventional GIP LCD.

To accomplish the invention objective, the liquid crystal display device according to the present invention comprises a liquid crystal panel, a gate driver unit, a clock generator, and a temperature compensation unit. The liquid crystal panel has a pixel array. The gate driver unit is utilized for generating a plurality of driving signals to drive the pixel array. The clock generator is electrically coupled to the gate driver unit. The temperature compensation unit is electrically coupled to the gate driver unit and the clock generator, and the temperature compensation unit is utilized for adjusting an output of the clock generator to compensate the driving signals generated from the gate driver unit according to a temperature variance.

In the method for driving the liquid crystal display device according to the present invention, the liquid crystal display device comprises a liquid crystal panel, a gate driver unit, a clock generator, and a temperature compensation unit. The method comprises steps below.

An output of the clock generator is adjusted by the temperature compensation unit.

The output of the clock generator is transmitted to the gate driver unit.

A plurality of driving signals from the gate driver unit is compensated according to the output.

The driving signals are transmitted to the pixel array.

The pixel array is driven by the driving signals.

The display device and the method for driving the same according to the present invention are capable of compensating the driving signals from the gate driver unit according to the temperature variance. As a result, the turn-on delay of the gate driver unit or the insufficient charging time of pixels due to the low driving signals can be improved.

DETAILED DESCRIPTION OF THE INVENTION

Figure 1:
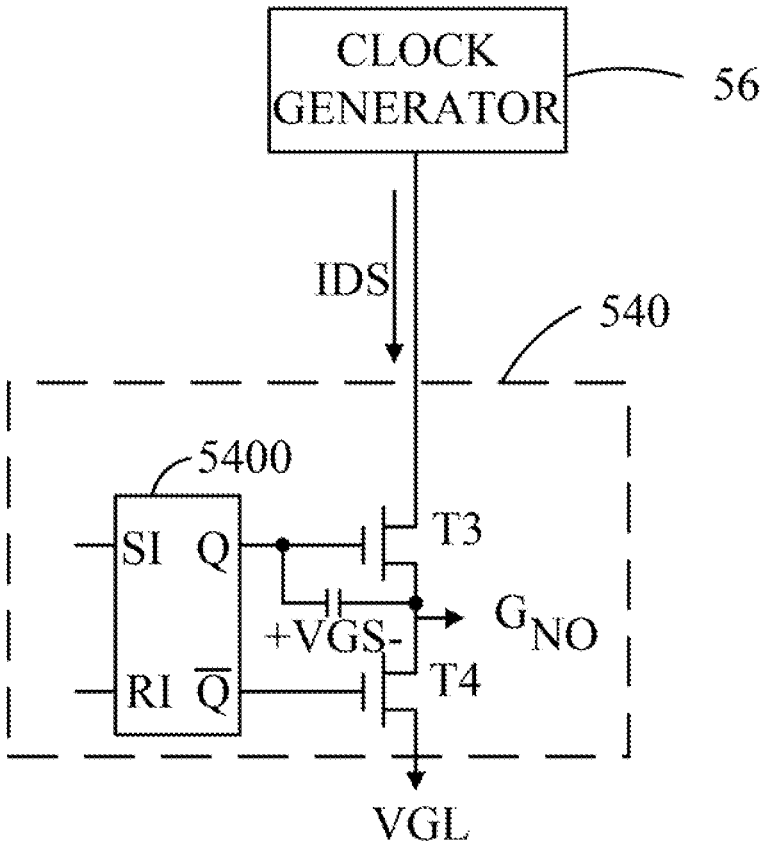
FIG. 1 (PRIOR ART)
FIG. 1 is a circuit diagram showing a shift register unit and a clock generator in the prior art.
Figure 2:
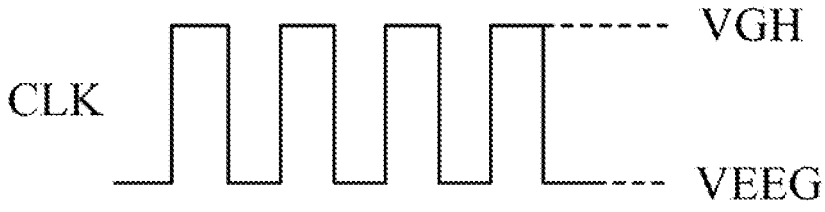
FIG. 2 (PRIOR ART)
FIG. 2 illustrates a waveform of an output CLK from the clock generator.
Figure 3:
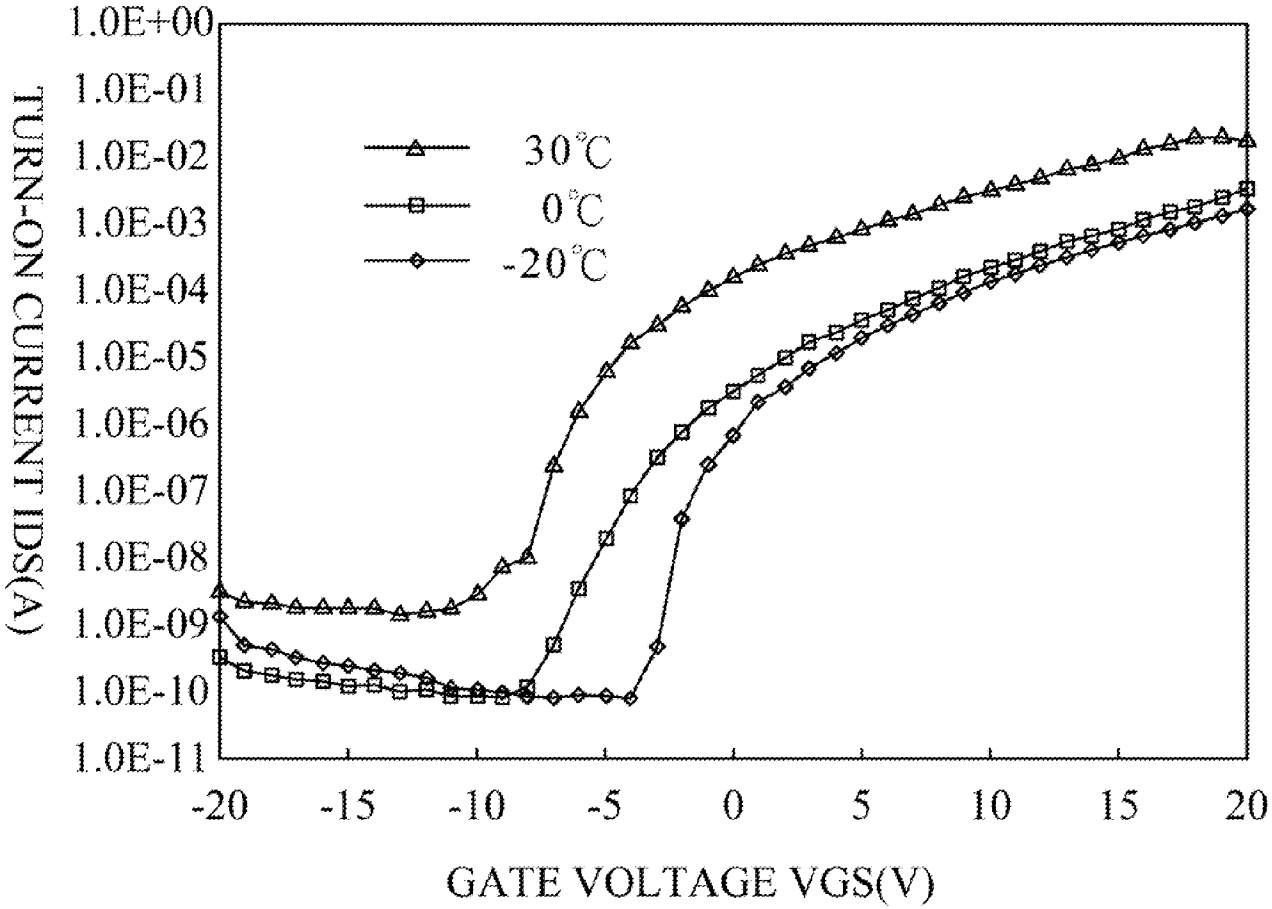
FIG. 3 (PRIOR ART)
FIG. 3 illustrates curves indicating relationships between a turn-on current IDS v. a gate voltage VGS (I-V) of the pull-up thin film transistor T3 at different temperatures.
Figure 4:
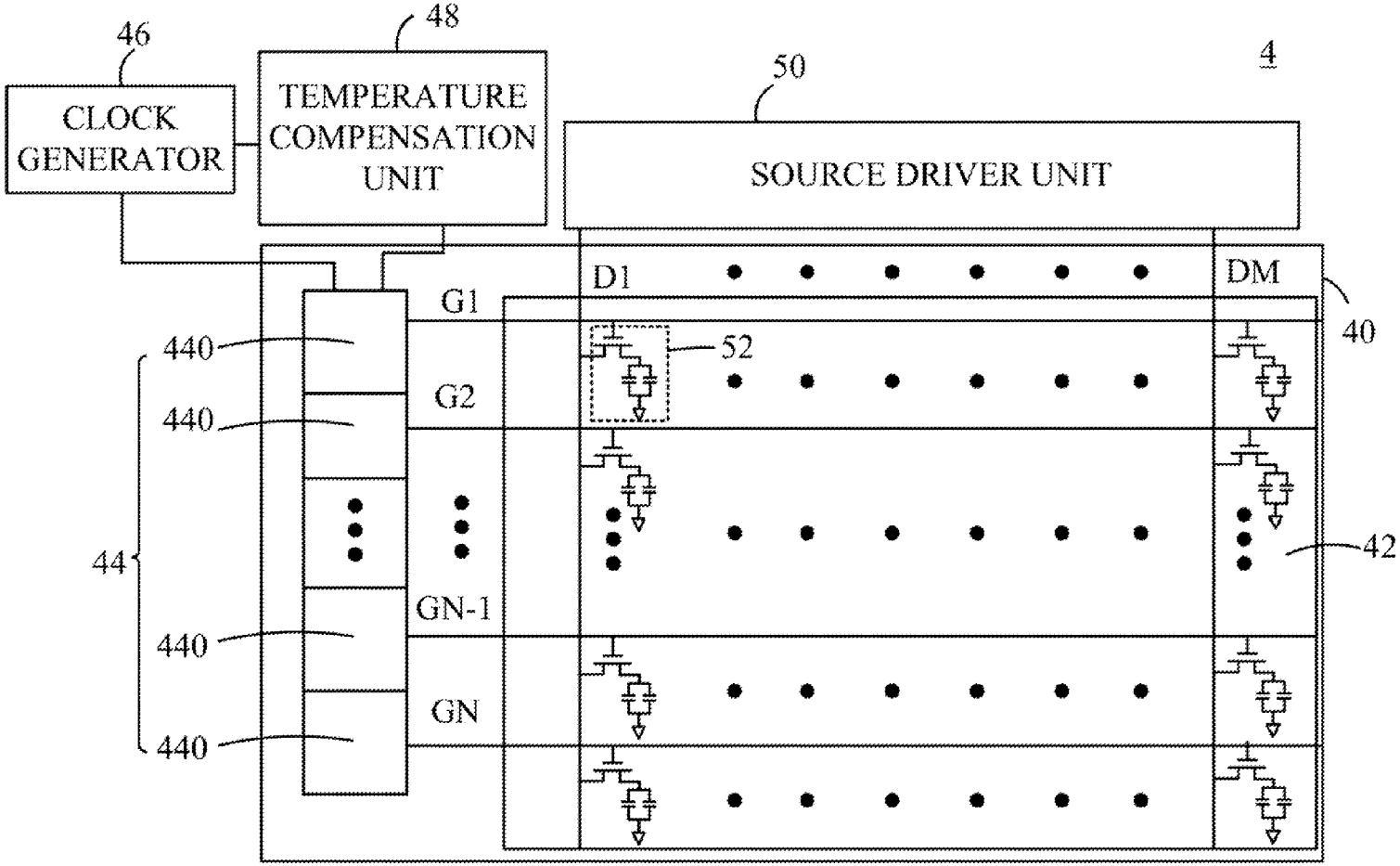
FIG. 4 illustrates a liquid crystal display device according to an embodiment of the present invention.

Please refer to FIG. 4, which illustrates a liquid crystal display device 4 according to an embodiment of the present invention. The liquid crystal display device 4 comprises a liquid crystal panel 40, a gate driver unit 44, a clock generator 46, a temperature compensation unit 48, and a source driver unit 50. The liquid crystal panel 40 has a pixel array 42 manufactured thereon. The pixel array 42 comprises N gate lines G1-GN, M source lines D1-DM, and N*M pixels 52. Since the liquid crystal display device 40 is a GIP LCD device, the gate driver unit 44 is manufactured on the liquid crystal panel 40. The gate driver unit 44 is electrically coupled to the gate lines G1-GN for generating a plurality of driving signals to drive the pixel array 42. The source driver unit 50 is electrically coupled to the source lines D1-DM for providing displaying data for the pixel array 42. The clock generator 46 is electrically coupled to the gate driver unit 44. The temperature compensation unit 48 is electrically coupled to the gate driver unit 44 and the clock generator 46, and the temperature compensation unit 48 is utilized for adjusting an output of the clock generator 46 to compensate the driving signals generated from the gate driver unit 44 according to a temperature variance.

The gate driver unit 44 comprises a plurality of shift register units 440 which are electrically coupled with each other in series, and each one of the shift register units 440 is corresponding to one row of the pixel array 42, i.e. one of the gate lines G1-GN. Please refer to FIG. 5, which is a circuit diagram showing the temperature compensation unit 48, the shift register unit 440, and the clock generator 46 according to a first embodiment of the present invention. The shift register unit 440 comprises an SR flip-flop 4400, a pull-up thin film transistor T5, a pull-down thin film transistor T6, and a first capacitor C1. The SR flip-flop 4400 comprises a first input SI and a second input RI. The first input SI is electrically coupled to a starting signal (not shown, when the shift register unit 440 is a first stage) or a gate line output $G_{NO}$ of one previous-stage shift register unit 440 (not shown, when the shift register unit 440 is one of a second stage to an N stage). The second input RI is electrically coupled to a gate line output $G_{NO}$ of one next-stage shift register unit 440 (not shown, when the shift register unit 440 is one of the first stage to the N−1 stage) or an ending signal (not shown, when the shift register unit 440 is the N stage). A gate G of the pull-up thin film transistor T5 is electrically coupled to a first output Q of the SR flip-flop 4400. A drain D of the pull-up thin film transistor T5 is electrically coupled to the clock generator 46. A source S of the pull-up thin film transistor T5 is electrically coupled to a drain D of the pull-down thin film transistor T6. A gate G of the pull-down thin film transistor T6 is electrically coupled to a second output $\overline{Q}$ of the SR flip-flop 4400. A source S of the pull-down thin film transistor T6 is electrically coupled to a third voltage VGL. The first capacitor C1 is electrically coupled between the gate G of the pull-up thin film transistor T5 and the source S of the pull-up thin film transistor T5. The gate line output $G_{NO}$ of the shift register unit 440 is electrically coupled to one of the gate lines G1-GN shown in FIG. 4, and the gate line output $G_{NO}$ serves as the driving signal source of one of the gate lines G1-GN.

Figure 5:
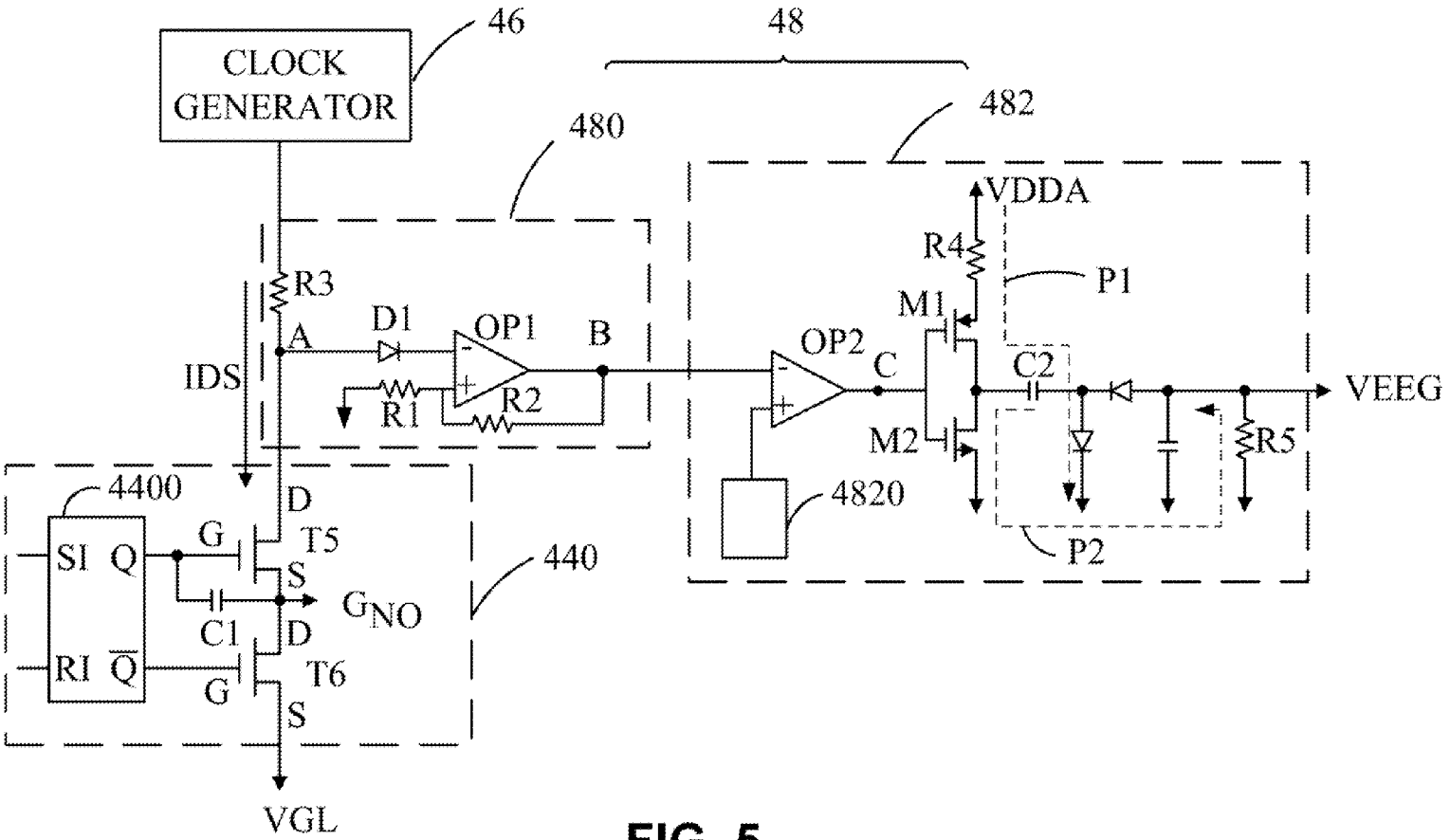
FIG. 5 is a circuit diagram showing the temperature compensation unit, the shift register unit, and the clock generator according to a first embodiment of the present invention.
Figure 6:
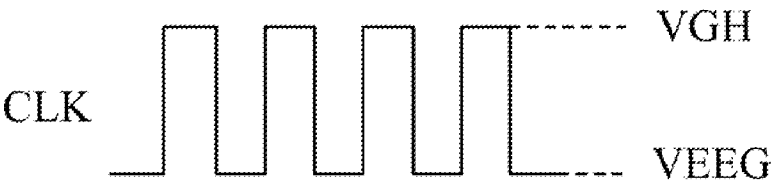
FIG. 6 illustrates a waveform of an output CLK from the clock generator.

Please refer to FIG. 6, which illustrates a waveform of an output CLK from the clock generator 46. The output CLK from the clock generator is a pulse wave having a high level of a first voltage VGH and a low level of a second voltage VEEG. Generally speaking, the first voltage VGH is a highest voltage generated by the clock generator 46, and the second voltage VEEG is a lowest voltage generated by the clock generator 46. The third voltage (as shown in FIG. 5) is not generated by the clock generator 46. The third voltage is provided by an external power supply (not shown).

Please refer to FIG. 5 and FIG. 6, the temperature compensation unit 48 comprises a current-to-voltage converter 480 and a negative voltage adjusting unit 482. The current-to-voltage converter 480 is electrically coupled to the drain D of the pull-up thin film transistor T5 for converting a variation of a turn-on current IDS to a variation of a voltage VB at a node B. The negative voltage adjusting unit 482 is electrically coupled to the current-to-voltage converter 480 for adjusting the output CLK from the clock generator 46 according to the variation of the voltage VB at the node B. More particularly, the negative voltage adjusting unit 482 adjusts the second voltage VEEG of the output CLK so as to reduce the second voltage VEEG, i.e. a voltage difference between the first voltage VGH and the second voltage VEEG is increased. In other words, the amplitude of the output CLK is increased, and therefore a gate voltage VGS crossing the first capacitor C1 is increased. The turn-on current IDS is also increased due to the increased gate voltage VGS. Accordingly, the problem of the reduced turn-on current IDS due to the reduced temperature is improved.

The current-to-voltage converter 480 comprises a first operational amplifier OP1, a first resistor R1, a second resistor R2, a third resistor R3, and a diode D1. The first operational amplifier OP1, the first resistor R1, and the second resistor R2 constitutes a non-inverting amplifier. The diode D1 is utilized for preventing a negative voltage from inputting to the first operational amplifier OP1. When the temperature is reduced, the turn-on current IDS is reduced and therefore a voltage VA at a node A is increased. It can be understood that the voltage VB at the node B is also increased according to the following formula.

$$VB = \left(1 + \frac{R2}{R1}\right)VA$$

The negative voltage adjusting unit 482 comprises a second operational amplifier OP2, a triangle generator 4820, a fourth resistor R4, a fifth resistor R5, a second capacitor C2, a first metal-oxide-semiconductor field-effect transistor (MOSFET) M1, and a second MOSFET M2. The second operational amplifier OP2 is utilized for comparing values of two inputs. When an output of the second operational amplifier OP2 is at a low level, the first MOSFET M1 is turned on and the second MOSFET M2 is cut-off. The second capacitor C2 is charged by a voltage VDDA via a path P1 and thus a voltage VC2 crossing the second capacitor C2 is increased. In contrarily, when the output of the second operational amplifier OP2 is at a high level, the first MOSFET M1 is cut-off and the second MOSFET M2 is turned-on. The voltage V2 crossing the second capacitor C2 is discharged via a path P2. In conclusion, when the output of the second operational amplifier OP2 is at a low level, the second capacitor C2 is charged; when the output of the second operational amplifier OP2 is at a high level, the second capacitor C2 is discharged.

Figure 7:
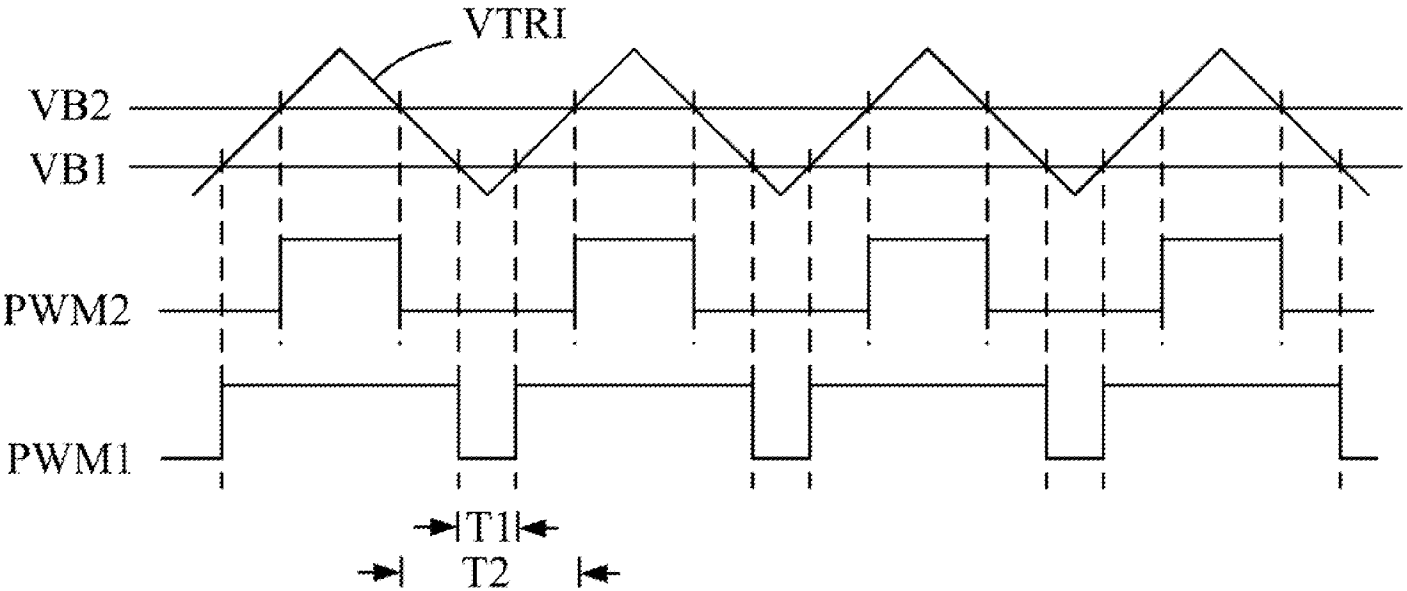
FIG. 7 illustrates waveforms of the input and output of the second operational amplifier.

Please refer to FIG. 5 and FIG. 7. FIG. 7 illustrates waveforms of the input and output of the second operational amplifier OP2. Before the temperature is reduced, the voltage at the node B is VB1. The second operational amplifier OP2 compares the voltage VB1 at the node B with an outputting voltage VTRI from the triangle wave generator 4820, and a waveform at a node C is a pulse wave voltage PWM1. A period of the pulse wave voltage PWM1 at a low level is T1. After the temperature is reduced, the voltage at the node B is increased to VB2. The second operational amplifier OP2 compares the voltage VB2 at the node B with the outputting voltage VTRI from the triangle wave generator 4820, the waveform at the node C is a pulse wave voltage PWM2. A period of the pulse wave voltage PWM2 at a low level is T2. The period T2 is longer than the period T1 as shown in FIG. 7. As mentioned above, when the output of the second operational amplifier OP2 is at a low level, the second capacitor C2 is charged. This represents that the charging time of the second capacitor C2 is longer after the temperature is reduced. As a result, the voltage VC2 crossing the second capacitor C2 is increased. In another aspect, after the second capacitor is discharged, a voltage crossing the fifth resistor R5 is more negative, i.e. the second voltage VEEG is more negative. The voltage difference between the first voltage VGH and the second voltage VEEG is increased, that is, the amplitude of the output CLK is increased, so that the voltage VGS crossing the first capacitor C1 is increased. As a result, the turn-on current IDS is increased as well.

Figure 8:
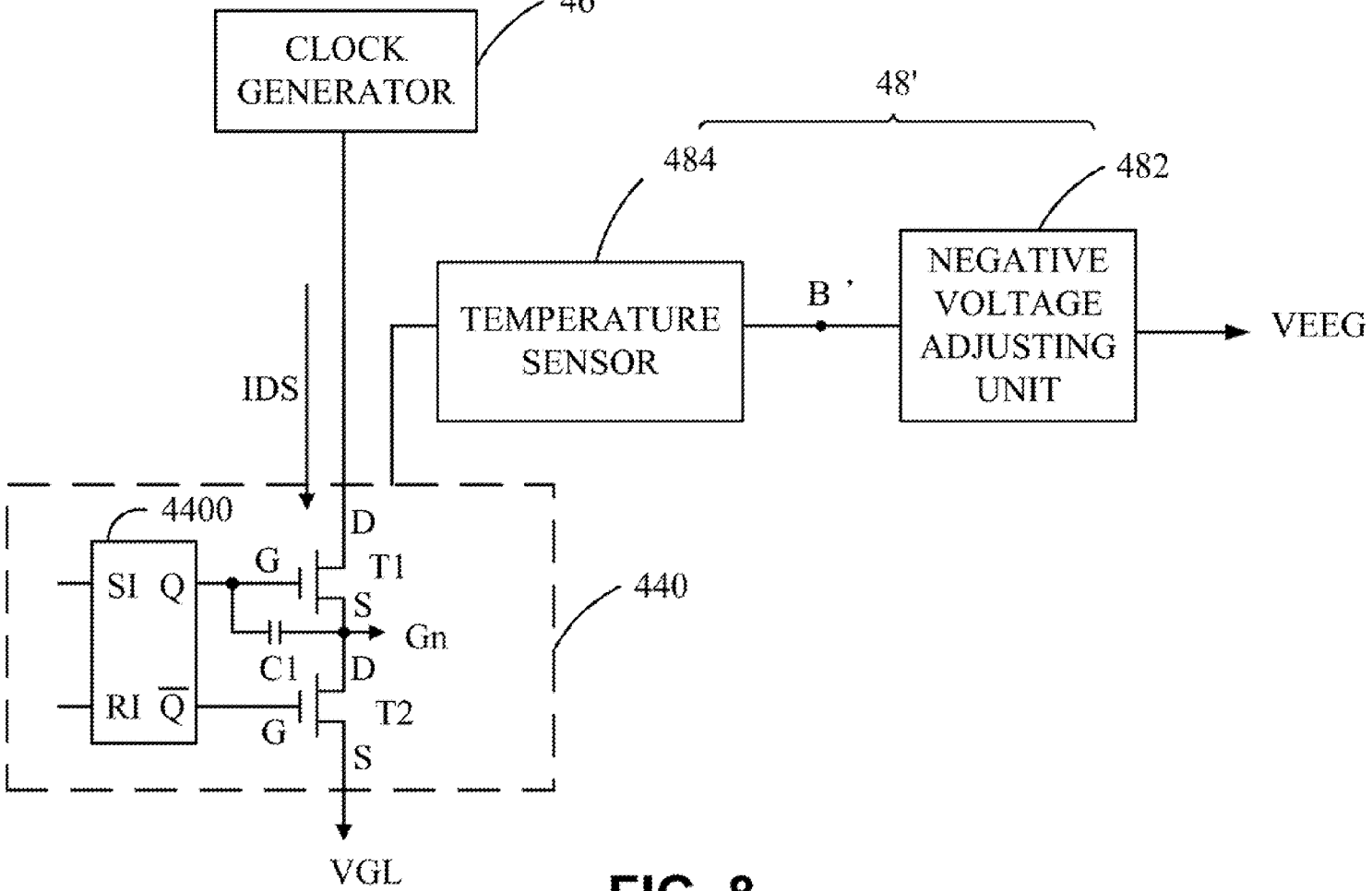
FIG. 8 is a circuit diagram showing a temperature compensation unit, the shift register unit, and the clock generator according to a second embodiment of the present invention.

Please refer to FIG. 6 and FIG. 8. FIG. 8 is a circuit diagram showing a temperature compensation unit 48', the shift register unit 440, and the clock generator 46 according to a second embodiment of the present invention. The shift register unit 440 and the clock generator 46 are the same as those shown in FIG. 5 and not repeated herein. The temperature compensation unit 48' comprises a temperature sensor 484 and a negative voltage adjusting unit 482. The temperature sensor 484 is utilized for sensing a temperature variation of either the pull-up thin film transistor T5 or the pull-down thin film transistor T6, and thus the temperature sensor 484 is preferably disposed near either the pull-up thin film transistor T5 or the pull-down thin film transistor T6. The temperature sensor 484 has a negative temperature coefficient. That is, when the temperature is increased, an outputting voltage of the temperature sensor 484 is reduced; when the temperature is reduced, the outputting voltage of the temperature sensor 484 is increased. Therefore, when the temperature is reduced, a voltage VB' at a node B' is increased. The negative voltage adjusting unit 482 is electrically coupled to the temperature sensor 484 for adjusting the output CLK from the clock generator 46 according to the variation of the voltage VB' at the node B'. More particularly, the negative voltage adjusting unit 482 adjusts the second voltage VEEG of the output CLK so as to reduce the second voltage VEEG, i.e. a voltage difference between the first voltage VGH and the second voltage VEEG is increased. In other words, the amplitude of the output CLK is increased, and therefore a gate voltage VGS crossing the first capacitor C1 is increased. The turn-on current IDS is also increased due to the increased gate voltage VGS. Accordingly, the problem of the reduced turn-on current IDS due to the reduced temperature is improved. One embodiment of the negative voltage adjusting unit 482 is the same as shown in FIG. 5 and not repeated herein.

Figure 9:
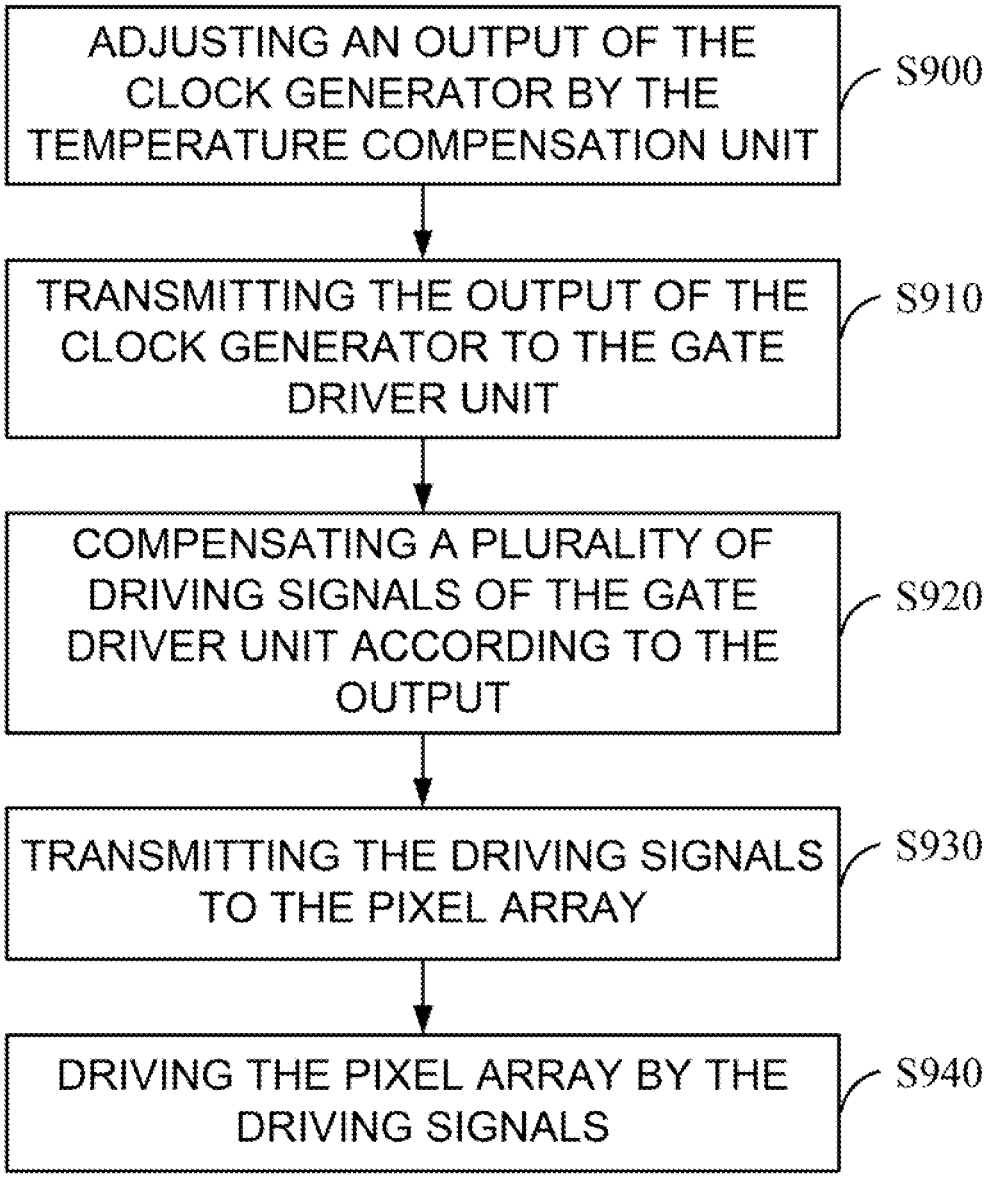
FIG. 9 illustrates a flow chart of a method for driving a liquid crystal display device.

Please refer to FIG. 9, which illustrates a flow chart of a method for driving a liquid crystal display device. The liquid crystal display device comprises a liquid crystal panel, a gate driver unit, a clock generator, and a temperature compensation unit. The liquid crystal panel comprises a pixel array. The method comprises steps below.

In step S900, an output of the clock generator is adjusted by the temperature compensation unit.

In step S910, the output of the clock generator is transmitted to the gate driver unit.

In step S920, a plurality of driving signals of the gate driver unit is compensated according to the output.

In step S930, the driving signals are transmitted to the pixel array.

In step S940, the pixel array is driven by the driving signals.

The gate driver unit comprises a plurality of shift register units which are electrically coupled with each other in series, and each one of the shift register units is corresponding to one row of the pixel array. The output of the clock generator is a pulse wave having a high level of a first voltage and a low level of a second voltage, and the temperature compensation unit increases a voltage difference between the first voltage and the second voltage to compensate the driving signals generated from the gate driver unit.

In one embodiment, the temperature compensation unit comprises a current-to-voltage converter and a negative voltage adjusting unit electrically coupled to the current-to-voltage converter. Step S900 comprises steps below.

A variation of a turn-on current of the gate driver unit is converted to a variation of a voltage by the current-to-voltage converter of the temperature compensation unit, and the second voltage from the clock generator is adjusted by the negative voltage adjusting unit according to the variation of the voltage, so that a voltage difference between the first voltage and the second voltage is increased. In other words, the amplitude of the output CLK is increased.

In another embodiment, the temperature compensation unit comprises a temperature sensor and a negative voltage adjusting unit electrically coupled to the current-to-voltage converter. Step S900 comprises steps below.

By the temperature sensor, a temperature variation of the gate driver unit is sensed and then the temperature variation of the gate driver unit is converted to a variation of a voltage, and the second voltage from the clock generator is adjusted by the negative voltage adjusting unit according to the variation of the voltage, so that a voltage difference between the first voltage and the second voltage is increased. In other words, the amplitude of the output CLK is increased.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A liquid crystal display device, comprising:

a liquid crystal panel having a pixel array;

a gate driver unit for generating a plurality of driving signals to drive the pixel array;

a clock generator electrically coupled to the gate driver unit; and a temperature compensation unit electrically coupled to the gate driver unit and the clock generator, the temperature compensation unit adjusting an output of the clock generator for compensating the driving signals generated from the gate driver unit according to a temperature variance of one of a plurality of shift register units of the gate driver unit, the output of the clock generator being a pulse wave having a high level of a first voltage and a low level of a second voltage, the temperature compensation unit comprising:

a temperature sensor for sensing the temperature variation of the one of the shift register units of the gate driver unit, and converting the temperature variation to a variation of a voltage; and a negative voltage adjusting unit electrically coupled to the temperature sensor for adjusting the second voltage from the clock generator according to the variation of the voltage.

2. The liquid crystal display device of claim 1, wherein the shift register units are electrically coupled with each other in series, and each one of the shift register units is corresponding to one row of the pixel array.

3. The liquid crystal display device of claim 2, wherein the temperature compensation unit increases a voltage difference between the first voltage and the second voltage to compensate the driving signals generated by the gate driver unit.

4. The liquid crystal display device of claim 3, wherein each one of the shift register units comprises:

a flip-flop comprising a first input, a second input, a first output, and a second output, the first input being electrically coupled to either a starting signal or a gate line output of one previous-stage shift register unit, and the second input being electrically coupled to either a gate line output of one next-stage shift register unit or an ending signal;

a pull-up thin film transistor comprising a gate, a drain, and a source, the gate of the pull-up thin film transistor being electrically coupled to the first output of the flip-flop, and the drain of the pull-up thin film transistor being electrically coupled to the clock generator;

a pull-down thin film transistor comprising a gate, a drain, and a source, the gate of the pull-down thin film transistor being electrically coupled to the second output of the flip-flop, the source of the pull-down thin film transistor being electrically coupled to a third voltage outputted by the clock generator, and the drain of the pull-down thin film transistor being electrically coupled to the source of the pull-up thin film transistor; and a first capacitor being electrically coupled between the gate of the pull-up thin film transistor and the source of the pull-up thin film transistor.

5. The liquid crystal display device of claim 1, wherein the temperature sensor comprises a negative temperature coefficient.

6. The liquid crystal display device of claim 1, wherein the temperature compensation unit increases a voltage difference between the first voltage and the second voltage to compensate the driving signals generated from the gate driver unit.

7. A liquid crystal display device, comprising:

a liquid crystal panel having a pixel array;

a gate driver unit for generating a plurality of driving signals to drive the pixel array;

a clock generator electrically coupled to the gate driver unit; and a temperature compensation unit electrically coupled to the gate driver unit and the clock generator, the temperature compensation unit adjusting an output of the clock generator for compensating the driving signals generated from the gate driver unit according to a temperature variance, the output of the clock generator being a pulse wave having a high level of a first voltage and a low level of a second voltage, the temperature compensation unit comprising:

a current-to-voltage converter electrically coupled to the gate driver unit for converting a variation of a turn-on current of the gate driver unit to a variation of a voltage; and a negative voltage adjusting unit electrically coupled to the current-to-voltage converter for adjusting the second voltage from the clock generator according to the variation of the voltage.

* * * * *